US007325335B2

(12) United States Patent
Cook-Euell

(10) Patent No.: US 7,325,335 B2
(45) Date of Patent: Feb. 5, 2008

(54) METHOD AND APPARATUS USED TO COMMUNICATE A MESSAGE TO BE WORN IN FOOTWEAR

(76) Inventor: Veronica Cook-Euell, 2365 Copley Rd., Akron, OH (US) 44320-1439

( * ) Notice: Subject to any disclaimer, the term of this patent is extended or adjusted under 35 U.S.C. 154(b) by 118 days.

(21) Appl. No.: 10/774,066

(22) Filed: Feb. 7, 2004

(65) Prior Publication Data

US 2005/0172519 A1 Aug. 11, 2005

(51) Int. Cl.
*A43B 3/24* (2006.01)

(52) U.S. Cl. ..... 36/100; 36/136

(58) Field of Classification Search ..... 36/112, 36/132, 136, 100

See application file for complete search history.

(56) References Cited

U.S. PATENT DOCUMENTS 2,464,571 A * 3/1949 Gardner ..... 36/1
3,906,642 A * 9/1975 Cohen ..... 434/260
4,050,168 A * 9/1977 Pace ..... 36/136
4,813,157 A * 3/1989 Boisvert et al. ..... 36/44
4,958,446 A 9/1990 Brown
5,331,753 A 7/1994 Rodibaugh
5,359,790 A 11/1994 Iverson et al.
5,367,795 A 11/1994 Iverson et al.
D356,599 S * 3/1995 Ashner ..... D20/27
5,445,420 A * 8/1995 Lairmore et al. ..... 283/117
5,457,900 A 10/1995 Roy
5,884,770 A * 3/1999 Galm ..... 206/575
6,434,870 B1 8/2002 Fanjoy
6,455,128 B1 9/2002 Moon
6,477,714 B1 * 11/2002 Boatwright ..... 2/171
6,523,289 B2 * 2/2003 Coplon et al. ..... 40/636
7,055,265 B1 * 6/2006 Bathum et al. ..... 36/3 B
2003/0070324 A1 4/2003 Nelson
2005/0151321 A1 * 7/2005 Hennessy et al. ..... 273/302

FOREIGN PATENT DOCUMENTS

GB 2167592 A * 5/1986

* cited by examiner

*Primary Examiner*—Jila M Mohandesi
(74) *Attorney, Agent, or Firm*—Hahn Loeser & Parks, LLP; Mark A. Watkins

(57) ABSTRACT

The present invention relates to a message-bearing apparatus or method of communicating a message for footwear and, in particular, to a color/pattern/picture coordinated message bearing method for wear inside footwear that carries a preprinted inspirational message on one side of the apparatus as well as a picture relating to the message in the background of the same side with the text.

5 Claims, 1 Drawing Sheet

METHOD AND APPARATUS USED TO COMMUNICATE A MESSAGE TO BE WORN IN FOOTWEAR

FIELD OF THE INVENTION

The present invention relates to a message-bearing apparatus and method of communicating a message for footwear and, in particular, to a color/pattern/picture coordinated message bearing method for wear inside footwear that carries a preprinted inspirational message on one side of the apparatus as well as a picture relating to the message in the background of the same side with the text.

BACKGROUND OF THE INVENTION

There are no other background inventions similar to this invention. Distinguish from other products—as will be appreciated, the foregoing provides prescribed formats for user information. In general only . . .

The invention is distinguished from other products as shown in the following paragraphs. The invention provides a method of communicating a message so that the user can gain information.

A further object of the invention is to provide a decorative message-bearing apparatus or method for any size shoes having an inspirational message on the heel portion of the apparatus, a corresponding Bible verse or message on the front part of the apparatus and a related inspirational topic along the upper edge of the apparatus.

Another object of the invention is to provide a message-bearing apparatus that is available in an array of colors and graphics for insertion of the apparatus into the wearer's shoes. The wearer's shoes have a pre-printed message that allows the wearer to stand on the word of God.

Yet another objective of the invention is to provide a method of providing inspirational apparatus for shoes wherein a plurality of apparatus in varying colors, sizes, shapes, graphics, and materials are provided with a variety of inspirational phrases on the surface.

BRIEF SUMMARY OF THE INVENTION

The foregoing objects and advantages are provided in the present invention by a message-bearing apparatus that is inserted into the wearer's shoe. The shoe apparatus and method of bearing a message may be selected from an inventory of various colors, shapes, and materials. Each shoe apparatus or method has a front surface containing a preprinted scripture verse and inspirational message or for the purposes of communicating a message or even advertising a message. Accordingly users may select an inspirational topic and design or message for their shoes. By wearing the apparatus or using the method thereof, within their shoes, users will be able to actually stand on the word of God. Users will be able to wear the message that is being communicated. Accordingly, the wearer will have a physical reminder of the inspiration message or message that they may take with them during every step of their day.

DESCRIPTION OF DRAWINGS

FIG. 2 is a side view of a shoe with apparatus placed in-side as shown in FIG. 2.

FIG. 1 illustrates;

DETAILED DESCRIPTION OF THE PREFERRED EMBODIMENTS

Figure 1:
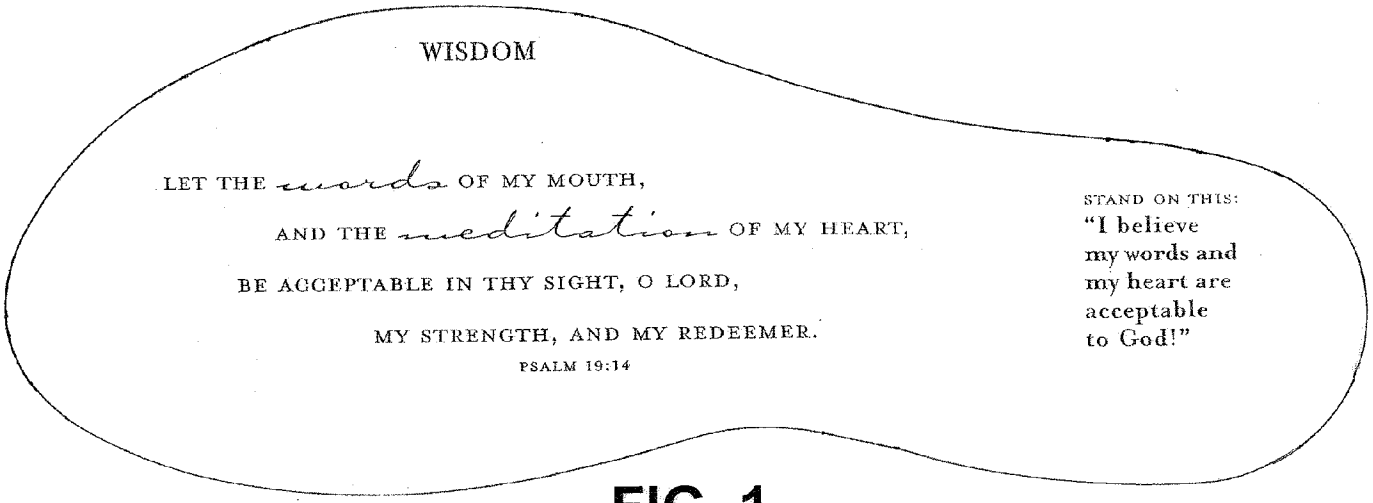
FIG. 1.
Figure 2:
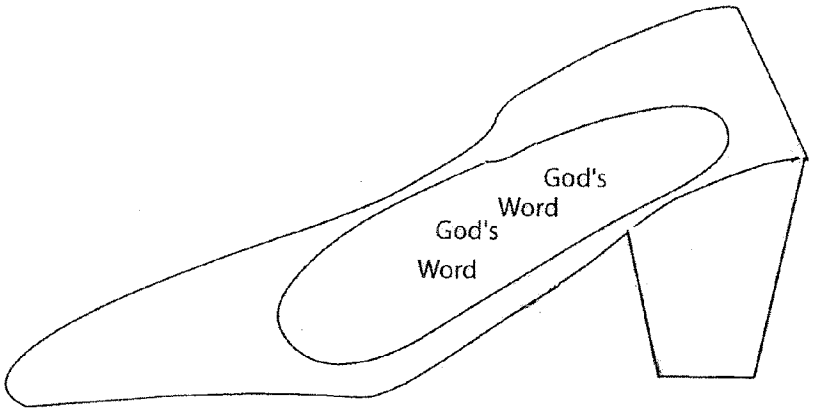
FIG. 2.

Referring to the drawings for the purposes of describing the preferred embodiments only and not for limiting the same, FIG. 1 Illustrates The actual apparatus bearing the graphical background design and inspirational scripture message as well as confirmation phrase to be worn by the user in the shoe. This method may also be used for communicating messages of all types and for all purposes. While hereinafter described with reference to anyone's shoes, it will become apparent that the present invention may be applied to footwear in general, everyday footwear or special purpose footwear, without regard to the age or gender of the wearer.

The message-bearing apparatus as shown in FIG. 1 may be formed in a variety of sizes, shapes, colors, and materials of interest to classes of shoe wearers. As well as applying to removable/temporary insoles, this invention is also adapted for permanent shoe insoles and cushioned comfort insoles. Preferably the apparatus' are formed of a plastic material having a suitable surface for bearing a printed, embossed, or otherwise preformed inspiration message or other form of messages. Option materials include: paper, cloth, and leather.

As illustrated in FIG. 1, the apparatus has a generally shoe shaped body. Accordingly, the apparatus will lay flat inside the shoe.

The apparatus may be formed of any thus suitable material such as paper, plastic, cloth, leather, or suitable surface material using a cushioned comfort insole is another option.

The shape of the body of the apparatus may also be varied in accordance with the preferences of the wearer and may be textured, embossed, colored, or otherwise stylishly emboldened as described.

The apparatus may be selected from an inventory of colors and categories. Each inspirational category may be provided with a correlating variety of preprinted messages. For instance, all apparatus' with messages relating to "wisdom" could have a picture in the background of mountains; those relating to "love" could have a picture of the sky and a dove, those relating to "salvation" could have a picture of water, and so forth for a number of different picture corresponding topics and methods of communicating messages.

The wearer would then select an apparatus with the inspirational topic or form or type of message they would like to wear for the scripture passage and inspiration message or advertisement on which they wished to stand on to indicate their support of. The wearer would then place the apparatus inside their shoe. The same or different apparatus could be worn daily according with the desires of the wearer. Depending on the chosen material the apparatus could be washable.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the spirit and scope of the present invention. The disclosure and descriptions herein are intended to be illustrative and are not in any sense limiting of the invention, which is defined solely in accordance with the following claims.

What is claimed:

1. A method of communicating an associated message, comprising the steps of:

providing a plurality of messages each relating to a different associated theme;

crafting a generally thin first article having a substantial uniform thickness for insertion into associated footwear, wherein the first article includes a first configuration of raised bosses and a first thematic pictorial image that in combination distinctly represents a first of said plurality of messages;

crafting at least a second generally thin article having a substantial uniform thickness for insertion into said associated footwear, wherein the at least a second article includes a second configuration of raised bosses and a second thematic pictorial image that in combination distinctly represents a second of said plurality of messages;

inserting at least one of the first and at least a second articles into associated footwear; and, wearing said footwear thereby communicating one or more of the plurality of messages.

2. The method of claim 1, wherein the first article is constructed from a substantially different material than the at least a second article; and, wherein the materials are selected from the group consisting of:

paper, plastic, cloth or leather.

3. The method of claim 1, wherein the first article and at least a second article are insole-shaped shoe inserts each having first and second ends respectively.

4. The method of claim 3, wherein the first configuration of raised bosses is positioned at a first end of the first article; and, wherein the second configuration of raised bosses is positioned at a second end of the at least a second article.

5. A method of claim 3, wherein the first article has a left-shoe insole shape; and, wherein the at least a second article has a right-shoe insole shape.

* * * * *